US009204668B2

(12) United States Patent
Garthaffner

(10) Patent No.: US 9,204,668 B2
(45) Date of Patent: Dec. 8, 2015

(54) CIGARETTE FILTER

(75) Inventor: Martin T. Garthaffner, Chesterfield, VA (US)

(73) Assignee: PHILIP MORRIS USA INC., Richmond, VA (US)

( * ) Notice: Subject to any disclaimer, the term of this patent is extended or adjusted under 35 U.S.C. 154(b) by 1116 days.

(21) Appl. No.: 12/211,182

(22) Filed: Sep. 16, 2008

(65) Prior Publication Data

US 2009/0075798 A1 Mar. 19, 2009

Related U.S. Application Data

(60) Provisional application No. 60/973,294, filed on Sep. 18, 2007.

(51) Int. Cl.
*B31C 99/00* (2009.01)
*A24D 3/02* (2006.01)

(52) U.S. Cl.
CPC ..... *A24D 3/0225* (2013.01); *A24D 3/0287* (2013.01)

(58) Field of Classification Search
CPC ..... A24D 3/0225; A24D 3/0287
USPC ..... 493/48, 39, 44, 45, 50; 131/94, 77
See application file for complete search history.

(56) References Cited

U.S. PATENT DOCUMENTS 3,482,488 A * 12/1969 Sexstone ..... 493/41
3,603,058 A * 9/1971 Schubert ..... 53/525
3,756,886 A 9/1973 Watson
3,762,281 A * 10/1973 Burrus et al. ..... 493/47
3,807,286 A * 4/1974 Sexstone ..... 493/45
3,847,064 A * 11/1974 Berger ..... 493/44
4,034,765 A * 7/1977 Hall ..... 131/336
4,185,645 A * 1/1980 Boegli et al. ..... 131/342
4,285,678 A 8/1981 Molins
4,321,050 A * 3/1982 Oesterling ..... 493/45
4,531,629 A * 7/1985 Seragnoli et al. ..... 198/458
4,817,638 A * 4/1989 Garthaffner et al. ..... 131/29
4,867,734 A * 9/1989 Okumoto et al. ..... 493/48
5,024,242 A * 6/1991 Garthaffner et al. ..... 131/94
5,425,383 A * 6/1995 Garthaffner et al. ..... 131/94
5,558,103 A * 9/1996 Garthaffner et al. ..... 131/94
7,479,099 B2 * 1/2009 Scott et al. ..... 493/47

FOREIGN PATENT DOCUMENTS

EP 1226765 7/2002
EP 1547477 6/2005
WO WO-2004056221 7/2004
WO WO-2005102080 11/2005

* cited by examiner

*Primary Examiner* — Sameh Tawfik
(74) *Attorney, Agent, or Firm* — Roberts Mlotkowski Safran & Cole, P.C.

(57) ABSTRACT

A process of producing a cigarette filter comprises the steps of assembly a filter segment comprising a hollow tube with a filter plug at one end thereof and a space adjacent the plug. The filter segment is horizontally positioned, and the space is partially filled with a predetermined amount of particulate filter material by applying vacuum to the end filter plug to thereby drawn the particulate material into the space. An elongate filter plug is horizontally positioned in alignment with and adjacent to the filled filter segment, and the filled filter segment and the elongate filter plug are moved together until that plug abuts the particulate filter material to thereby seal the space and the particulate material therein. The formed filter is ultimately joined to a wrapped tobacco rod.

15 Claims, 2 Drawing Sheets

CIGARETTE FILTER

CROSS REFERENCE RELATED TO APPLICATION

The present application claims the benefit of provisional application Ser. No. 60/973,294, filed Sep. 18, 2007, for all useful purposes, and the specification and drawings thereof are included herein by reference.

BACKGROUND OF THE INVENTION

The present invention relates to cigarette filters, and more particularly to cigarette filters that include vacuum deposited particulate filter material.

A variety of cigarette filters have been proposed over the years, and many of these filters include granular filter material particularly in so-called plug-space-plug filters. In these filters, spaced apart plugs, usually made of cellulose acetate, define a cavity therebetween which is filled with granulated material, such as granulated carbon, for example. The filters are attached to wrapped tobacco rods with tipping paper to produce the finished cigarettes. In many instances, the granulated material is vertically filled into the cavity during filter manufacture.

It is important that the cavity between the cellulose acetate plugs be sufficiently filled with particulate material so that tobacco smoke comes into contact with the material as it is drawn through the filter. Insufficient fill causes so-called channeling of the smoke as it passes through the cavity which results in less efficient filtering.

SUMMARY OF THE INVENTION

One of the primary objects of the present invention is a cigarette filter that includes a sufficiently packed bed of particulate material.

Another object of the present invention is the feature of horizontally depositing particulate material into the cavity of a cigarette filter in a manner that produces a packed bed of material with improved filtering efficiency.

Still another object of the present invention is a cigarette filter having a packed bed of particulate material with substantially less material than similar filter constructions, but which operates with the same or increased efficiency due to the fully packed nature of the bed.

In accordance with the present invention, a method is provided for producing a cigarette filter that comprises the steps of assembling a filter segment comprising a hollow tube with a filter plug at one end thereof and a space adjacent the plug. The filter segment is horizontally positioned, and the space is partially filled with a predetermined amount of particulate filter material by applying vacuum to the end filter plug to drawn the particulate material into the space.

Preferably the filter plug is cellulose acetate and the particulate filter material is granulated carbon.

The filling step initially comprises placing a predetermined amount of particulate filter material next to the space, and the material is then vacuum deposited within the space. Thereafter, an elongate filter plug in alignment with and adjacent to the filled filter segment is horizontally positioned, and the filled filter segment and elongate filter plug move together until the elongate filter plug abuts the particulate filter material.

The present invention also includes a process for simultaneously producing a pair of cigarette filters comprising the steps of initially assembling a pair of filter segments, each comprising a hollow tube with a plug at one end thereof and a space adjacent each plug. The pair of filter segments is horizontally positioned in spaced apart alignment with one another with the spaces facing each other. Each space is partially filled with a predetermined amount of particulate filter material by applying vacuum to each end filter plug to thereby draw the particulate material into the space of each filter segment.

The filling step initially comprises placing a predetermined amount of particulate filter material next to each space which is then vacuum deposited within each space. Thereafter, a central elongate filter plug is horizontally positioned in alignment with and between the filled filter segments which are then pushed against the central elongate filter plug until each end of the elongate filter plug abuts the particulate material in the space of each filter segment to thereby form an integral pair of plug-space-plug filters with each space filled with particulate material.

The central elongate filter plug may be cut in half midway along its length to thereby produce a pair of plug-space-plug filters with each space filled with particulate material. Alternatively, a wrapped tobacco rod may be joined to each end of the integral pair of plug-space-plug filters, and thereafter the elongate filter plug may be cut in half midway along its length to thereby produce a pair of cigarettes each with a plug-space-plug filter filled with particulate material.

Preferably the end filter plugs and the central elongate filter plug comprise cellulose acetate, and the particulate material is granulated carbon.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
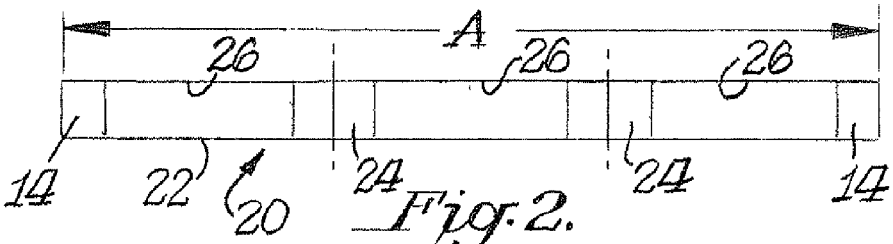
FIG. 1 is an elevational view of cigarette filter assembly for producing six filter segments.
Figure 2:
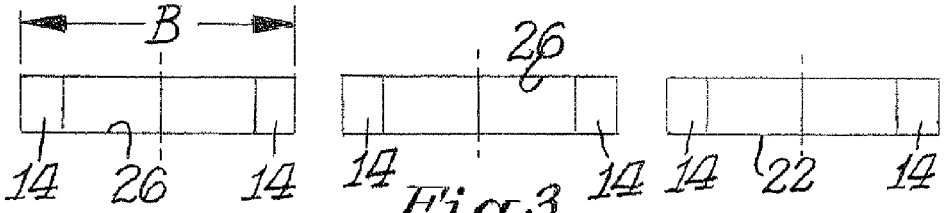
FIG. 2 is an elevational view of the cigarette filter assembly of FIG. 1 after the first two cuts have divided the assembly into three sub-assemblies.
Figure 3:
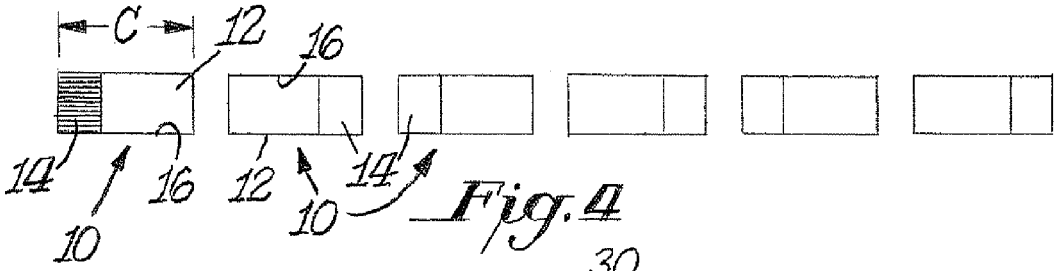
FIG. 3 is an elevational view of the three filter subassemblies of FIG. 2, each cut in half to produce two filter segments for a total six segments.

Referring in more particularity to the drawings, FIGS. 1-3 diagrammatically illustrate assembly of a filter segment 10 comprising a hollow tube fabricated from paper 12 with a filter plug 14 at one end thereof and a space 16 adjacent the plug.

Initially an integral filter assembly 20 is formed for producing six filter segments 10. A paper tube 22 includes spaced apart plugs 14, 24 along its overall length A, with spaces 26 between the plugs. The filter assembly 20 is shown in FIG. 1.

The next step of assembly is shown in FIG. 2 where the cigarette filter assembly 20 is cut midway through each interior plug 24 to produce three subassemblies 28 each having a length B. Each subassembly 28 includes end plugs 14 with a space 26 between the plugs. Thereafter each subassembly 28 is cut in half midway along its length, as shown in FIG. 3, to thereby produce six filter segments 10 each having a length C. The space 26 of each subassembly 28 is thereby divided in half to produce the spaces 16 of each filter segment 12.

Figure 4:
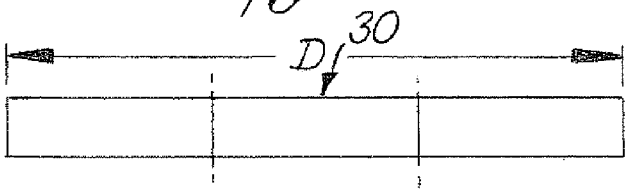
FIG. 4 is an elevational view of a wrapped cellulose acetate filter rod.
Figure 5:
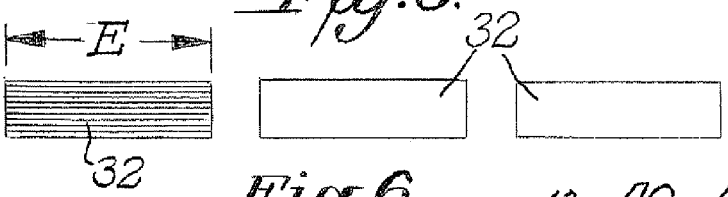
FIG. 5 is an elevational view of the wrapped cellulose filter rod of FIG. 4 cut into three wrapped cellulose acetate filter segments.

FIG. 4 shows a wrapped cellulose acetate filter rod 30 having an overall length D. The wrapped filter rod is cut into three equal elongate filter plugs 32 each having a length E, as shown in FIG. 5.

Figure 6:
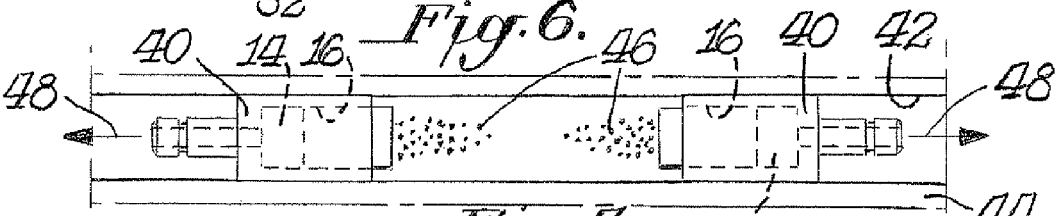
FIG. 6 is an elevational view of two filter segments of FIG. 3, each positioned within a vacuum plunger with the two filter segments and plungers lying in one of the flutes of a fluted drum and with vacuum being applied to the plungers to draw particulate filter material into each filter segment.

The space 16 of each filter segment 10 is partially filled with a predetermined amount of particulate filter material in the following manner. Initially a pair of vacuum plungers 40 are horizontally positioned in one of the flutes 42 of a fluted drum 44. A filter segment 10 is positioned within each vacuum plunger with the spaces 16 facing one another, as shown in FIG. 6. A predetermined amount of particulate material 46 is then positioned next to the space 16 of each filter segment 10, and the material is then vacuum deposited within each space by applying vacuum 48 to the end filter plug 14 of each filter segment 10.

Figure 7:
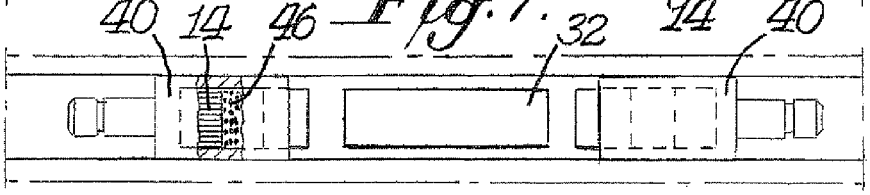
FIG. 7 is an elevational view similar to FIG. 6, but with the filter segments filled with particulate filter material and one of the wrapped cellulose acetate filter segments of FIG. 5 positioned for assembly within one of the flutes of a fluted drum.

After the spaces 16 are partially filled with particulate material 46, an elongate filter plug 32 is positioned in the flute 42 between the two partially filled filter segments 10 such as shown in FIG. 7. The vacuum plungers then move toward on another which positions the elongate filter plug 32 against the particulate material 46 in each filter segment 10. This step in the overall assembly is best shown in FIG. 8.

As a result of this overall procedure the space 16 of each filter segment 10 includes a sufficiently packed bed of particulate material 46, and the pack bed has improved filtering efficiency. Moreover, with a packed bed of particulate material, substantially less material is needed than similar filter constructions, but nevertheless such filters operate with the same or increased efficiency due to the fully packed nature of the bed.

Figure 8:
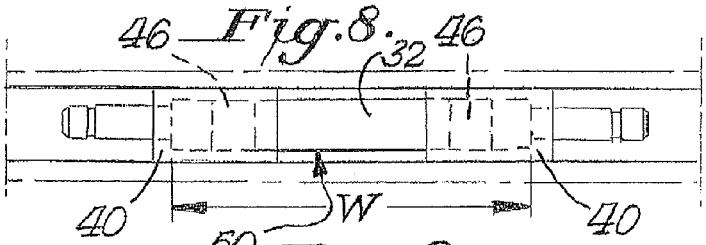
FIG. 8 is an elevational view similar to FIG. 7, but showing the wrapped cellulose acetate filter segment assembled with the two particulate filled filter segments.
Figure 9:
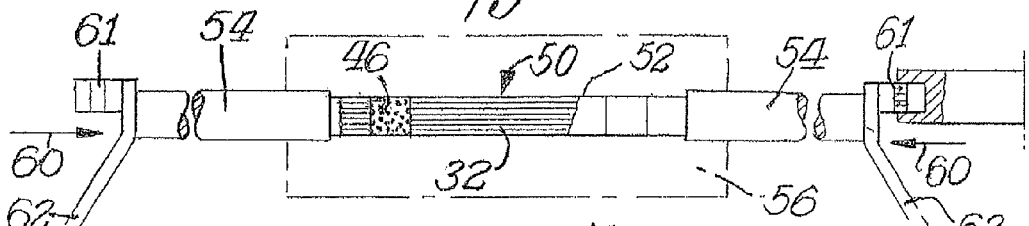
FIG. 9 is an elevational view of the filter assembly of FIG. 8 with a tobacco rod at each end thereof.
Figure 10:
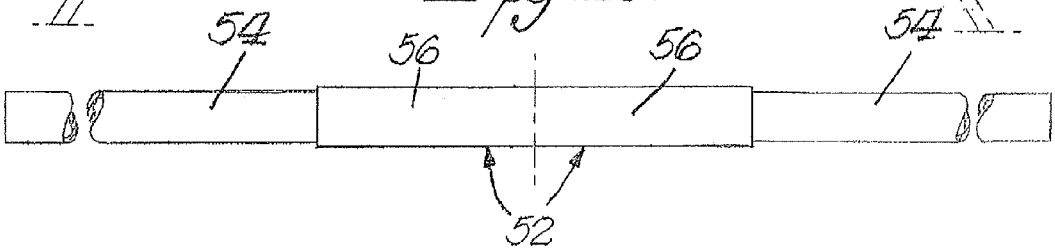
FIG. 10 is an elevational view similar to FIG. 9 with tipping paper joining the filter assembly to the tobacco rods.
Figure 11:
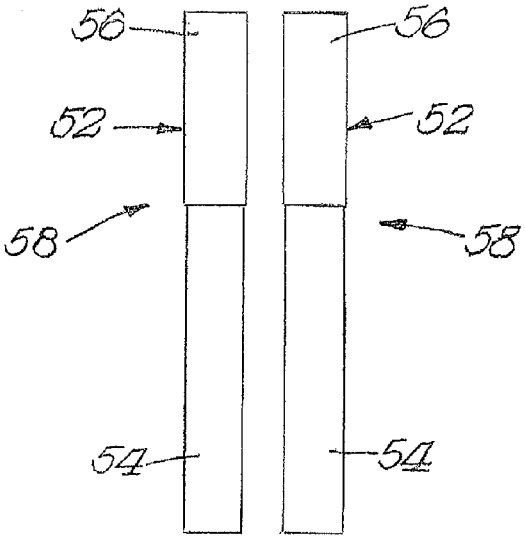
FIG. 11 is an elevational view showing the filter assembly of FIG. 10 cut in half to produce two individual cigarettes.

The filter product of the present invention shown in FIG. 8 fundamentally comprises an integral pair 50 of plug-space-plug filters 52 with each space 16 filled with a sufficiently packed bed of particulate material 46. The central elongate filter plug 32 may be cut in half midway along its length to thereby produce two plug-space-plug filters 52. Alternatively, as shown in FIGS. 9 and 10, a wrapped tobacco rod 54 may be joined to each end of the integral pair 50 of plug-space-plug filters 52 with tipping paper 56. Thereafter, the elongate filter plug 32 may be cut in half midway along its length to thereby produce a pair of cigarettes 58 each with a plug-space-plug filter 52 filled with a sufficiently packed bed of particulate material 46.

Referring to FIGS. 8-10, the integral pair 50 of plug-space-plug filters 52 are held together by fiction of the slightly smaller outer diameter of the wrapped acetate filter 32 inside the open ends of hollow paper tubes 16 containing the materials 46. The pair 50 are further compressed as desired for a 100% filled cavity by a force 60 applied to the end of the tobacco rods 54 as shown in FIG. 10. In this regard, a pair of swash plate rings 62 apply the desired assembly pressure 60 by a pair of ball bearings 61 riding on the outer surface of rings 62. While held in the compressed cavity state, tipping paper 56 is applied to hold the integral pair 50 compressed and to attach tobacco rods 54 as well. By adjusting the rings 62 closer together or further apart the "tightness" of the cavities 16 can be controlled.

What is claimed is:

1. A process for producing a cigarette filter comprising the steps of:

assembling at least one filter segment comprising a hollow tube with a filter plug at one end thereof and a space adjacent the plug;

positioning the filter segment; and partially filling the space with a predetermined amount of particulate filter material by applying vacuum axially through the end filter plug to thereby draw the particulate material into the space.

2. The process of claim 1, wherein the filter plug is cellulose acetate and the particulate filter material is granulated carbon.

3. The process of claim 1, wherein the filling step initially comprises placing a predetermined amount of particulate filter material next to the space, then depositing the particulate filter material within the space by applying the vacuum through the end filter plug.

4. The process of claim 3, further comprising the step of positioning an elongate filter plug in alignment with, and adjacent to, the filled filter segment, and moving the filled filter segment and the elongate filter plug together until the elongate filter plug abuts and compresses the particulate filter material.

5. The process of claim 4, wherein the filter segment is horizontally positioned upon a flute of a rotating drum during the filling step and the filled filter segment and the end filter plug move together.

6. The process of claim 1 comprising:

assembling a pair of filter segments each comprising a hollow tube with a plug at one end thereof and a space adjacent each plug;

positioning the pair of filter segments in spaced apart alignment with one another with the spaces facing each other; and partially filling each space with a predetermined amount of particulate filter material by applying vacuum axially through each end filter plug to thereby draw the particulate material into the space of each filter segment.

7. The process of claim 6, wherein each end filter plug is cellulose acetate and the particulate filter material is granulated carbon.

8. The process of claim 6, wherein the filling step initially comprises placing a predetermined amount of particulate filter material next to each space, then depositing the particulate filter material within each space by applying the vacuum through each end filter plug.

9. The process of claim 8, further comprising the step of positioning a central elongate filter plug in alignment with, and between, the filled filter segments, and pushing the filled filter segments against the central elongate filter plug until each end of the elongate filter plug abuts and compresses the particulate material in the space of each filter segment to thereby form an integral pair of plug-space-plug filters with each space filled with compressed particulate material.

10. The process of claim 9, wherein the pair of filter segments is horizontally positioned upon a flute of a rotating drum both during the filling step and during the step of pushing the filled filter segments against the central elongate filter plug.

11. The process of claim 9, further comprising the step of cutting the elongate filter plug in half midway along its length to thereby produce a pair of plug-space-plug filters with each space filled with particulate filter material.

12. The process of claim 9, further comprising the step of joining a wrapped tobacco rod to each end of the integral pair of plug-space-plug filters, and cutting the central elongate filter plug in half midway along its length to thereby produce a pair of cigarettes each with a plug-space-plug filter filled with compressed particulate material.

13. The process of claim 12, wherein the end filler plugs and the central elongate filter plug comprise cellulose acetate, and the particulate filter material is granulated carbon.

14. A process for producing a cigarette filter comprising the steps of:

assembling at least one filter segment comprising a hollow tube with a filter plug at one end thereof and a space adjacent the plug;

positioning the filter segment;

filling the space with a predetermined amount of particulate filter material by applying vacuum axially through the end filter plug to thereby draw the particulate material into the space, the filling step initially comprising placing a predetermined amount of particulate filter material next to the space, then depositing the particulate filter material within the space by applying the vacuum through the end filter plug; and positioning an elongate filter plug in alignment with, and adjacent to, the filled filter segment, and moving the filled filter segment and the elongate filter plug together until the elongate filter plug abuts and compresses the particulate filter material.

15. A process of producing a packed bed of particulate material, comprising:

establishing a pair of segments, each segment comprising:

a tubular portion;

a vacuum transmissive plug at a location along said tubular portion; and a space within said tubular portion adjacent said vacuum transmissive plug;

placing pairs of said segments in a spaced-apart relation on a flute of a fluted drum, said placing including orienting said spaces such that they face one another;

positioning a predetermined amount of particulate material adjacent said oriented spaces;

vacuum depositing said positioned particulate material within each of said oriented spaces by drawing vacuum through each of said vacuum transmissive plugs with a vacuum plunger so as to establish partially filled segments;

positioning a central plug at a location along said flute between said partially filled segments; and positioning said central plug against particulate material in each of said partially filled segments by moving said vacuum plungers toward one another to thereby establish a packed bed of particular material between each of said vacuum transmissive plugs and said central plug.

* * * * *